US007412931B2

(12) United States Patent
Seidl et al.

(10) Patent No.: US 7,412,931 B2
(45) Date of Patent: Aug. 19, 2008

(54) QUICK CRANK ADJUSTABLE HEIGHT TABLE

(75) Inventors: Lon D. Seidl, Green Bay, WI (US); James A. Tierney, Little Chute, WI (US)

(73) Assignee: Krueger International, Inc., Green Bay, WI (US)

( * ) Notice: Subject to any disclaimer, the term of this patent is extended or adjusted under 35 U.S.C. 154(b) by 180 days.

(21) Appl. No.: 10/514,697

(22) PCT Filed: Jun. 6, 2003

(86) PCT No.: PCT/US03/18015

§ 371 (c)(1), (2), (4) Date: Nov. 17, 2004

(87) PCT Pub. No.: WO03/103447

PCT Pub. Date: Dec. 18, 2003

(65) Prior Publication Data

US 2006/0075941 A1 Apr. 13, 2006

(51) Int. Cl.
*A47B 9/00* (2006.01)

(52) U.S. Cl. ..... 108/147

(58) Field of Classification Search ..... 248/161, 248/162.1, 157, 422; 108/147, 144.11, 147.19
See application file for complete search history.

(56) References Cited

U.S. PATENT DOCUMENTS 3,207,099 A * 9/1965 Black et al. ..... 108/141
3,820,176 A * 6/1974 Feiertag ..... 5/611
4,351,245 A * 9/1982 Laporte ..... 108/136
4,593,874 A * 6/1986 Dunagan ..... 248/188.4

(Continued)

FOREIGN PATENT DOCUMENTS

GB 1498963 1/1978

(Continued)

*Primary Examiner*—Janet M Wilkens
(74) *Attorney, Agent, or Firm*—Boyle Frederickson, S.C.

(57) ABSTRACT

A table or desk assembly (20) includes a base having a pair of legs (24), a worksurface (22) supported by and between the pair of legs, and a rapid, counterbalanced height adjustment mechanism interposed between the legs and the worksurface for providing adjustment in the elevation of the worksurface. The height adjustment mechanism includes a pair of high lead rotatable threaded rods (32) engaged with a mating stationary threaded member (33) associated with each leg. A handle (36) is engageable with one of the threaded rods for imparting rotation to the threaded rod, and a synchronizing arrangement, such as a sprocket (38) and chain system (40), is interconnected with the other of the threaded rods for rotating the threaded rods together. A lift assist or counterbalancing mechanism applies an upward bias, such as to the worksurface, to counteract the weight of the worksurface and any loads supported by the worksurface. The counterbalancing mechanism may be in the form of a cylinder assembly (54) having a biased retractable and extendible member, which is interconnected with each of the threaded rods via a cable (66) and pulley (68) arrangement. Alternatively, the lift assist or counterbalancing mechanism may be in the form of constant force spring arrangements (76), each of which has an extendible and retractable member. A retainer arrangement (90) is interposed between the crank or handle member (36) and the worksurface, for preventing inadvertent rotation of the threaded rod and thereby maintaining the elevation of the worksurface.

36 Claims, 9 Drawing Sheets

U.S. PATENT DOCUMENTS

| | | | | | |
|---|---|---|---|---|---|
| 5,022,327 | A | * | 6/1991 | Solomon | 108/147 |
| 5,289,782 | A | * | 3/1994 | Rizzi et al. | 108/147 |
| 5,311,827 | A | * | 5/1994 | Greene | 108/147 |
| 5,400,721 | A | | 3/1995 | Greene | |
| 5,507,204 | A | | 4/1996 | Diffrient | |
| 5,598,789 | A | * | 2/1997 | Jonker | 108/147 |
| 5,682,825 | A | * | 11/1997 | Manner | 108/147 |
| 6,119,605 | A | * | 9/2000 | Agee | 108/147 |
| 6,289,825 | B1 | * | 9/2001 | Long | 108/147 |
| 6,484,648 | B1 | * | 11/2002 | Long | 108/147 |
| 6,546,880 | B2 | | 4/2003 | Agee | |

FOREIGN PATENT DOCUMENTS

| | | |
|---|---|---|
| WO | WO 96/23433 | 8/1996 |

* cited by examiner

QUICK CRANK ADJUSTABLE HEIGHT TABLE

BACKGROUND AND SUMMARY

This invention relates to an article of furniture such as a desk, table or other structure having a worksurface, and more particularly to a system for providing rapid adjustment of the height of the worksurface relative to a supporting surface such as a floor.

It is known to provide a table or desk with a height adjustment feature for enabling the height of the worksurface to be adjusted relative to a supporting surface such as a floor. In a typical construction, an adjustable height table or desk includes a base having a pair of spaced apart supports or legs, which are configured to support a top or worksurface that extends between and is supported by the legs. Each leg includes a rotatably threaded rod, the upper end of which is interconnected with the worksurface. A handle or crank is interconnected with at least one of the threaded rods, such that manual rotation of the crank or handle imparts rotation to the threaded rod. A synchronizing drive arrangement, such as a chain and sprocket arrangement, is interconnected between the rods, such that rotation of one of the rods is operable to rotate the other.

In a prior art construction of this type, the table or desk must be designed to meet certain loading criteria, which is typically established either by customer requirements or by conventional testing criteria, and the height adjustment mechanism must be designed to accommodate the maximum amount of load to be supported by the worksurface. This requires the threads of the rods and the mating stationary threaded members to have a relatively high thread count, i.e. number of threads per unit length. By using a high density thread construction of this type, a relatively small amount of force is required to turn the crank or handle in order to adjust the height of the worksurface, even when the worksurface is loaded with the maximum amount of load. In this manner, the height of the worksurface can be adjusted by a wide range of users including those who are unable to apply a large amount of force to the handle, i.e. persons who do not have a great deal of arm or upper body strength.

While the above-described height adjustment mechanism provides a satisfactory arrangement for adjusting the height of a worksurface, it entails certain disadvantages in that the rate of adjustment is relatively slow and a large number of turns are required in order to accomplish even relatively small adjustment in the height of the worksurface, due to the required high density pitch of the threads of the threaded members.

It is an object of the present invention to provide a table, desk or other article of furniture having a worksurface, and including a height adjustment mechanism that is capable of providing rapid adjustment in the height of the worksurface. Yet another object of the invention is to provide such a table, desk or other article of furniture in which the height of the worksurface can be adjusted by imparting a relatively small number of revolutions to a crank or handle associated with the table, desk or other article of furniture. Yet another object of the invention is to provide a height adjustment mechanism for an article of furniture such as a table, desk or the like, which operates and is constructed in a manner generally similar to that of known worksurface height adjustment mechanisms. A still further object of the invention is to provide such a height adjustment mechanism that includes a feature for preventing inadvertent rotation of the crank or handle at all times other than when it is desired to adjust the height of the worksurface.

In accordance with the present invention, an article of furniture such as a table, desk or the like includes a base arrangement including a pair of spaced apart supports or legs and a top or other structure defining a worksurface, which extends between and is supported by the legs, in combination with a height adjustment mechanism for selectively altering the elevation of the worksurface and a lift assist or counterbalancing arrangement for loads carried by the worksurface during movement of the worksurface by operation of the height adjustment mechanism.

The height adjustment mechanism is in the form of a pair of rotatable threaded rods, each of which is interconnected at an upper end with the worksurface and is in threaded engagement with a stationary threaded member associated with one of the legs. The rods and the stationary threaded members have mating high lead threads, which provide a relatively high ratio of axial translation to angular rotation. That is, the threads of the rods and the stationary threaded members function to provide a high degree of axial adjustment, i.e. adjustment in the height of the worksurface, in response to rotation of the rods.

The lift assist or counterbalancing mechanism is configured to apply an upward bias on the worksurface. In combination with the high lead configuration of the threads on the rods and the mating threads of the stationary threaded members, the upward bias applied by the counterbalancing or lift assist mechanism functions to urge rotation of the threaded rods. In this manner, the upward bias on the worksurface provided by the lift assist or counterbalancing mechanism functions to counteract downward forces due to the weight of the worksurface as well as any loads carried by the worksurface, such that the threaded rods can be rotated relatively easily to adjust the height of the worksurface. The lift assist or counterbalancing mechanism is designed to provide a substantially constant biasing force throughout the entire range of movement of the worksurface relative to the legs.

In one embodiment, the lift assist or counterbalancing mechanism is in the form of a cylinder assembly having an extendible and retractable member that is biased in an outward direction. A pair of cables are interconnected with the extendible and retractable member. Each cable is engaged via a pulley arrangement with the extendible upper section of one of the legs, such as by engagement of the end of the cable with a cup member interconnected with the lower end of leg upper section. The extendible and retractable member is biased toward an extended position, and the cables and the pulley arrangements function to translate the outward bias of the extendible and retractable member into an upward force applied to the upper sections of the legs. The cylinder assembly is preferably mounted to a cross-member forming a part of the base of the table or desk, which extends between and interconnects the pair of spaced apart legs.

In another embodiment, the lift assist or counterbalancing mechanism is in the form of a constant force spring arrangement, in which an extendible and retractable spring strip member is biased toward a wound, retracted position. In one version, a separate spring arrangement is provided for each of the threaded rods. A cable is interconnected between each threaded rod and one of the extendible and retractable members, such as by means of a pulley arrangement. The spring arrangements are supported by a cross-member forming a part of the base and extending between the pair of spaced apart legs.

In accordance with another aspect of invention, a retainer arrangement is interposed between the worksurface and the crank or handle member, to prevent inadvertent rotation of the threaded rod. The retainer arrangement includes a hub member that is engaged with an upper end defined by one of the threaded rods, and the crank or handle member is engageable with the hub member so as to enable a user to selectively rotate the threaded rod through the crank or handle member and the hub member. The hub member and the worksurface include mating engagement structure, which is engaged so as to prevent rotation of the hub member when the hub member is in an engaged position, and is disengaged so as to enable rotation of the hub member when the hub member is in a disengaged position. The hub member is biased toward the engaged position, and is manually movable to the disengaged position by the user against the biasing force, so as to selectively enable rotation of the threaded rod through rotation of the crank or handle member. In one form, the hub member is movable along an axis coincident with the longitudinal axis of the threaded rod, for movement between the engaged and disengaged positions. In one embodiment, the worksurface includes a recess within which the upper end of the threaded rod is located, and the hub member includes a base or flange located within the recess and an outwardly extending sleeve which is configured for engagement with the crank or handle member. The worksurface includes a cover or locking member configured to enclose the recess and to overlie the base of the hub member, and to include an opening through which the sleeve extends. The engagement structure is interposed between the base of the hub member and a facing surface defined by the locking member or cover.

The invention contemplates a table, desk or other similar article of furniture having an adjustable top or worksurface, as summarized above, as well as an adjustment mechanism for a worksurface and a method of adjusting the elevation of a worksurface, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
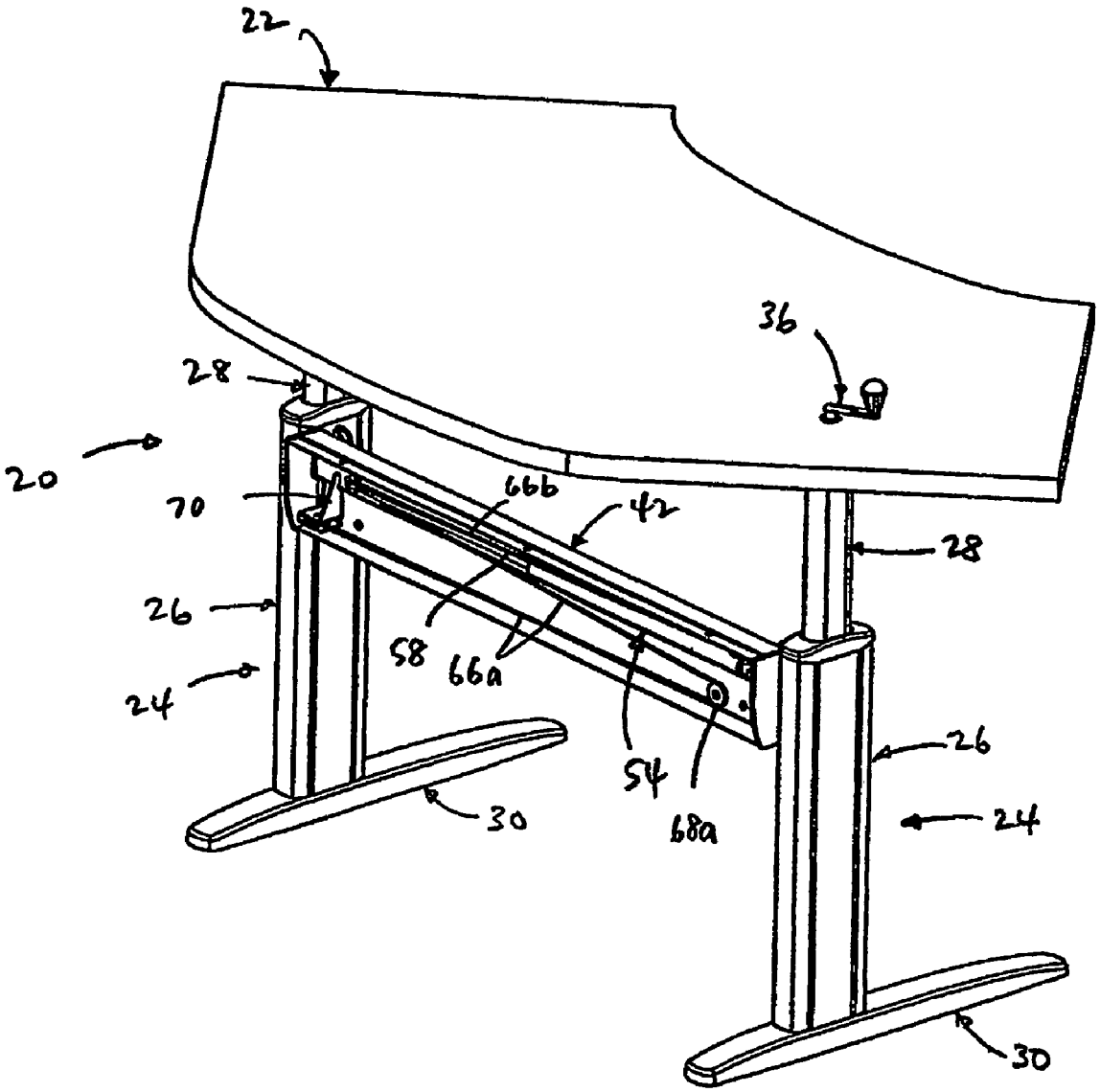
FIG. 1 is an isometric view of a table or desk assembly having a height adjustment mechanism in accordance with the present invention, for adjusting the height of the top or worksurface of the table or desk assembly.
Figure 2:
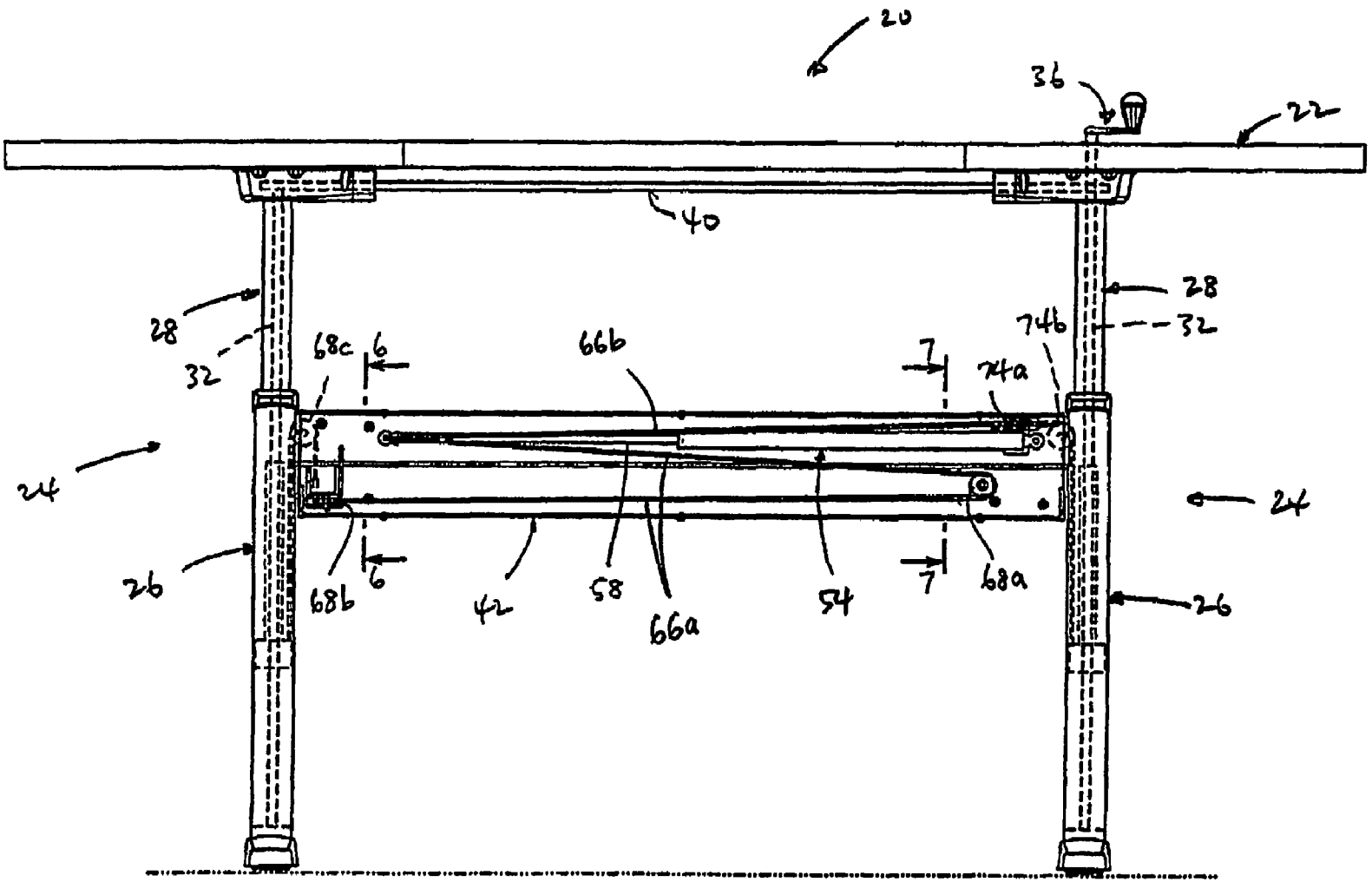
FIG. 2 is a front elevation view of the table or desk assembly of FIG. 1, showing the worksurface in a raised position.

As shown in FIGS. 1 and 2, an adjustable height article of furniture, such as a desk or table 20 generally includes a tabletop or worksurface 22 and a base including a pair of spaced apart supports, in the form of adjustable height leg assemblies 24, which are operable to vary the elevation of worksurface 22. Leg assemblies 24 and their component parts are similarly constructed. As necessary throughout this description, the designation "a" will be used in connection with one of leg assemblies 24 and its component parts, and the designation "b" will be used in connection with the other of leg assemblies 24 and its component parts.

Each adjustable height leg assembly 24 includes a tubular lower section 26 and an upper section 28 that is extendible and retractable relative to lower section 26, in a conventional telescoping manner. At its lower end, each lower section 26 is secured to a foot 30, which is operable to support leg assembly 24 above a floor or other supporting surface, shown at 29. At its upper end, upper section 28 of each leg assembly 24 is connected to the underside of worksurface 22 in a conventional manner, such as by means of a housing 31 that is secured to the underside of worksurface 22 and to which the upper end of leg upper section 28 is secured in a known manner.

Figure 4:
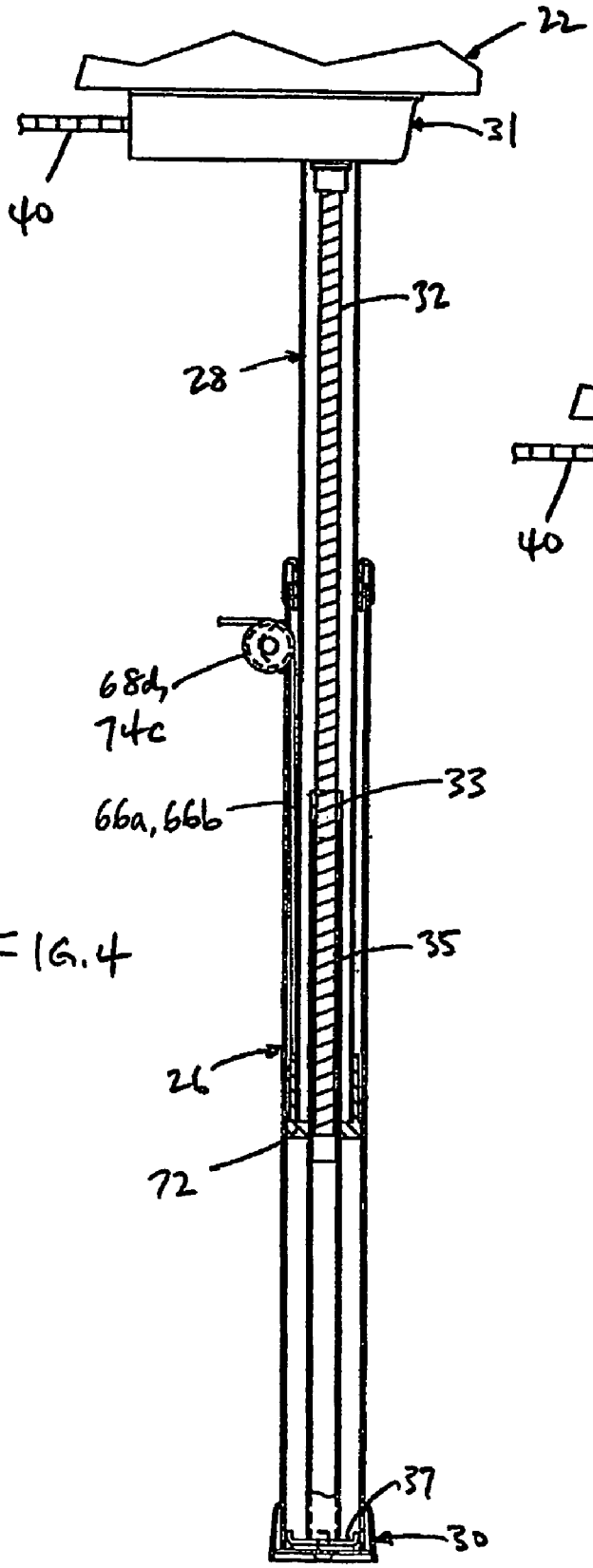
FIG. 4 is a partial section view taken through one of the extendible and retractable legs incorporated into the base of the table or desk assembly of FIGS. 1-3, showing the leg in an extended position corresponding to the raised position of the worksurface as shown in FIG. 2.
Figure 5:
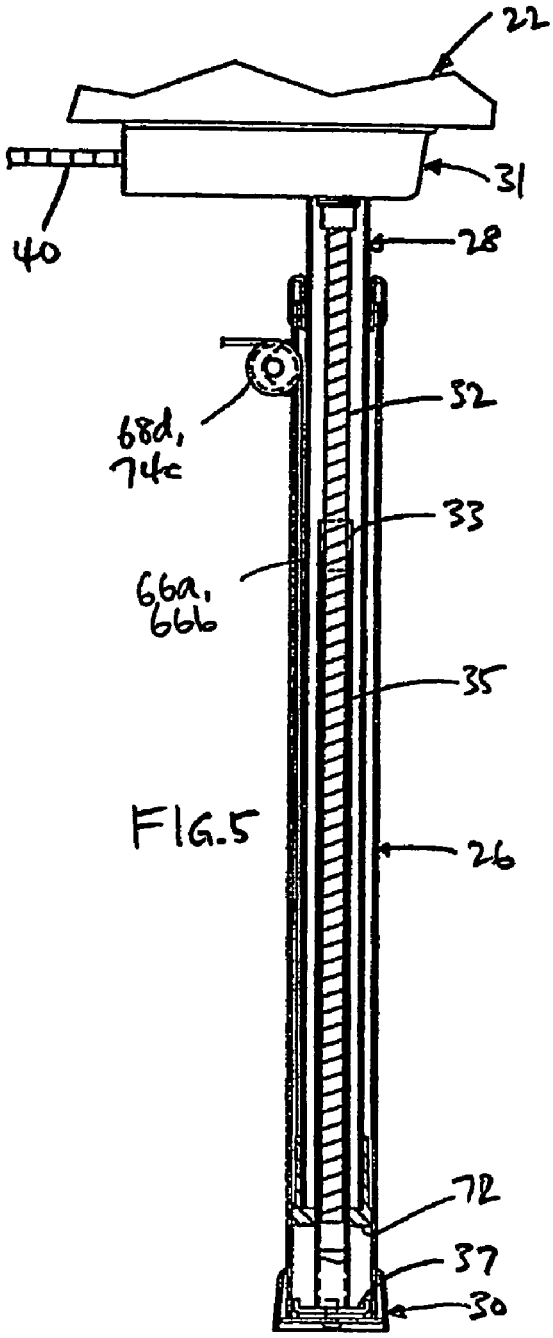
FIG. 5 is a view similar to FIG. 4, showing the leg assembly in a retracted position corresponding to the lowered position of the worksurface as shown in FIG. 3.

In accordance with the present invention, and as shown in FIGS. 4 and 5, upper section 28 of each leg assembly 24 includes an axially extending rotatable lead screw 32, which is engaged with a fixed-position lead nut 33 interconnected with leg assembly lower section 26. In the illustrated construction, lead nut 33 is mounted to the upper end of a guide tube 35, which is fixed at its lower end to a bracket 37 forming a part of foot 30. Rotation of lead screw 32 relative to fixed-position lead nut 35 results in extension or retraction of leg assembly upper section 28 relative to lower section 26 in a telescoping manner, to raise and lower worksurface 22. It is understood that the details of lower leg section 26, including the specific configuration of lead nut 33 and the manner in which it is supported in the interior of lower leg section 26, is representative of numerous different ways in which lead nut 33 may be stationarily supported within the interior of lower leg section 26 and engaged with lead screw 32.

In accordance with the present invention, lead screw 32 and lead nut 33 have high lead screw threads, to provide quick adjustment in the elevation of worksurface 22. Representatively, the threads of lead screw 32 and lead nut 33 may be configured to provide an elevation adjustment of approximately 0.80 inches per revolution of lead screw 32, although it is understood that any other high lead thread pitch may be used. In this manner, rotation of lead screw 32 causes rapid movement of worksurface 22, in contrast to prior art fine pitch screw-type adjustment mechanisms which provide very small amounts of adjustment per revolution.

A crank or handle member 36 is engaged with the upper end of one of lead screws 32, and extends above the upper surface of worksurface 22. Handle member 36 is adapted to be rotated by a user from above worksurface 22, to impart rotation to lead screws 32 in order to adjust the elevation of worksurface 22. Alternatively, handle member 36 may be located under worksurface 22, in a known manner.

A synchronizing mechanism is interconnected between lead screws 32, so that rotation of one of the lead screws 32 by operation of handle member is operable to impart rotation to the other lead screw 32. The synchronizing mechanism includes a sprocket 38 (FIGS. 8-10) located below worksurface 22 and contained within each housing 31. Each sprocket 38 is secured in a non-rotatable manner to the upper end of its associated lead screw 32. Sprockets 38 are at the same elevation, and a chain 40 (FIGS. 2-5) is trained about sprockets 38 to provide synchronous movement of both lead screws 32 upon rotation of one of the lead screws 32 via handle member 36. In the drawings, chain 40 is shown as being exposed, and it is understood that chain 40 may also be contained within a channel-type housing or the like mounted to the underside of worksurface 22. In this manner, extendible and retractable upper sections 28 of leg assemblies 24 are moved upwardly and downwardly together relative to lower sections 26 upon rotation of handle member 36. Again, it is understood that the illustrated and described synchronizing mechanism is illustrative, and that any other satisfactory system, including a gear/shaft-type synchronizing mechanism, may be employed to synchronously rotate lead screws 32.

The base of table 20 further includes a beam 42 that extends between lower sections 26 of adjustable height leg assemblies 24. Beam 42 functions to interconnect lower sections 26 of leg assemblies 24, to provide a rigid supporting structure for worksurface 22. In addition, as will later be explained, beam 42 supports a lift assist or counterbalancing arrangement in accordance with the present invention, which is operable to apply a vertical upward force to each lead screw 32 and to thereby assist in upward adjustment in the elevation of worksurface 22.

Figure 3:
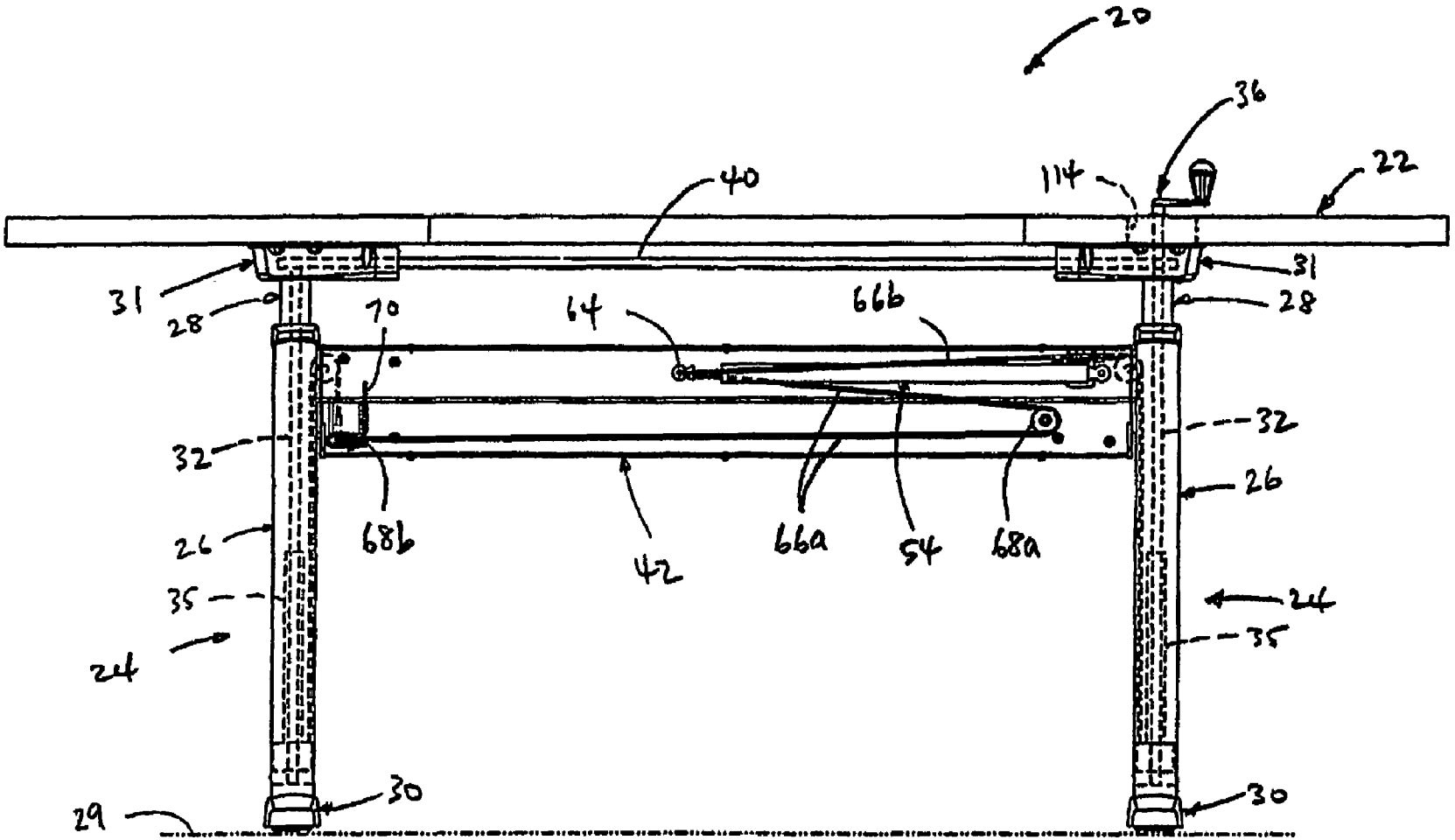
FIG. 3 is a view similar to FIG. 2, showing the worksurface in a lowered position.
Figure 6:
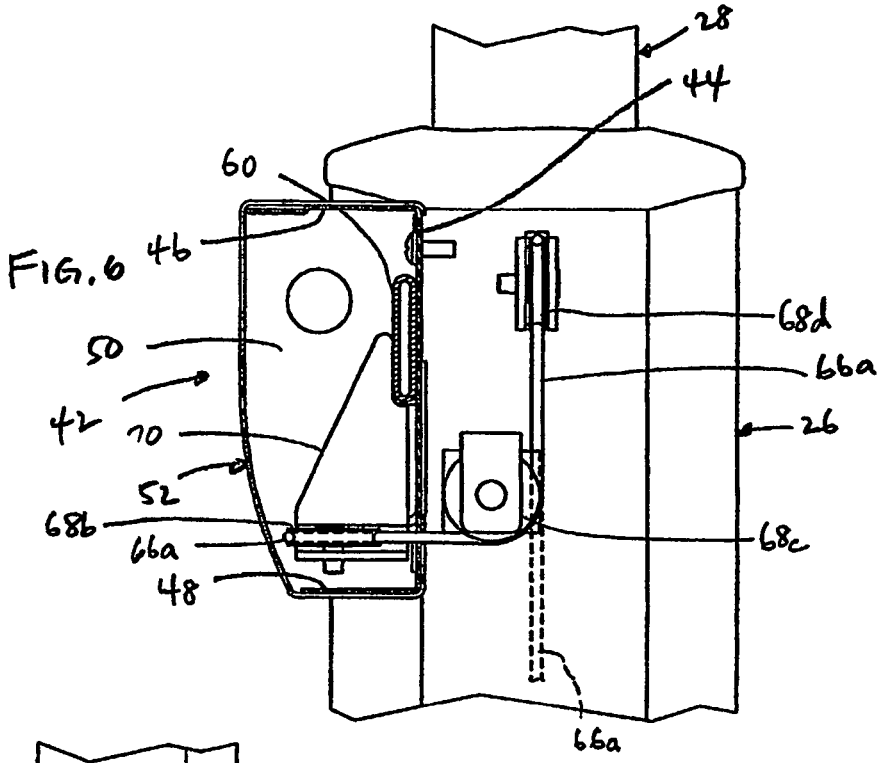
FIG. 6 is a partial section view taken along line 6-6 of FIG. 2.
Figure 7:
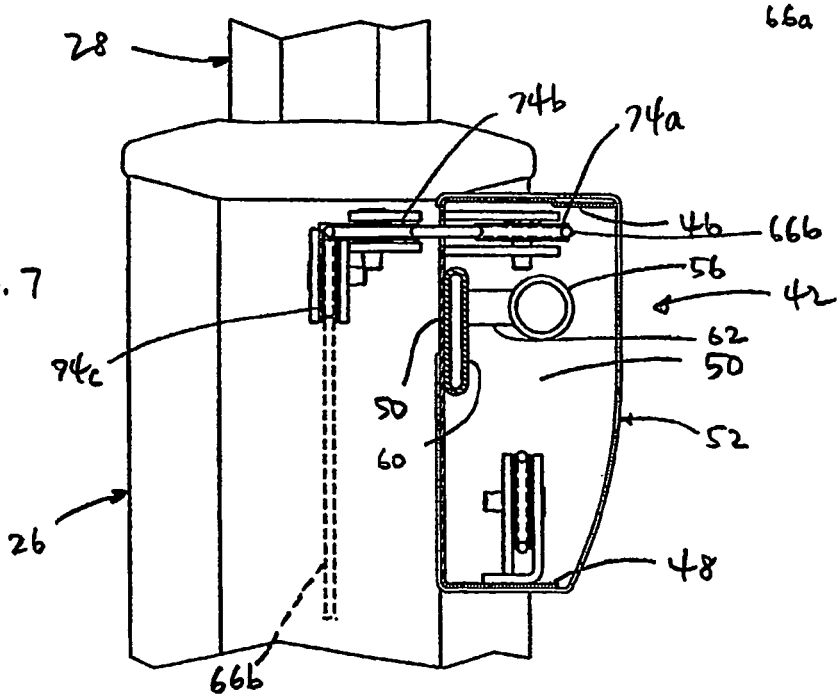
FIG. 7 is a partial section view taken along line 7-7 of FIG. 2.

As shown in FIGS. 6 and 7, beam 42 is generally channel-shaped, and includes a vertical wall 44, a top horizontal wall 44 and a bottom horizontal wall 46. With this construction, beam 42 defines an open interior area 50, and a cover 52 is engaged with the walls of beam 42 to enclose interior area 50. FIGS. 1-3 illustrate beam 42 with cover 52 removed, so as to provide visibility of the lift assist or counterbalancing arrangement carried by beam 42.

In accordance with one embodiment of the present invention, the lift assist or counterbalancing arrangement includes a biased gas cylinder assembly 54 (FIGS. 1-3) supported by beam 42. Gas cylinder assembly 54 includes a cylinder body 56 and an extendible and retractable member in the form of a rod 58, which is movable inwardly and outwardly relative to cylinder body 56 in a manner as is known. Gas cylinder assembly 54 includes an internal biasing arrangement, such as a spring, which interacts between cylinder body 56 and rod 58 so as to bias rod 58 outwardly toward an extended position relative to cylinder body 56. Representatively, gas cylinder assembly 54 may be a gas cylinder assembly such as is available from Suspa of Grand Rapids, Mich. under its model number 16-6-474-400-B73-1000N, although it is understood that any other satisfactory biased cylinder arrangement may be employed. Gas cylinder assembly 54 is selected such that the biasing force applied to rod 58 is substantially constant throughout the range of extension and retraction of rod 58. Gas cylinder assembly 54 is mounted to beam 42 in any satisfactory manner. In the illustrated embodiment, a flat tubular member 60 is secured to vertical wall 44 of beam 42, and gas cylinder body 54 is secured to flat tubular member 60 via a mounting bracket 62. With this construction, gas cylinder assembly 54 is oriented so as to apply a biasing force on rod 58 in a direction in a generally horizontal direction along a longitudinal axis defined by beam 42, which is generally perpendicular to the generally vertical longitudinal axes of leg assemblies 24.

A force transmission arrangement or system is interconnected between rod 58 of gas cylinder assembly and each of lead screws 32, and is constructed and arranged such that the outward bias on rod 58 is operable to apply on upward bias on each lead screw 32. In the illustrated embodiment, the force transmission arrangement or system is in the form of a cable and pulley system interconnected between rod 58 and lead screws 32. As shown in FIGS. 2-7, a cable connector 64 is secured to the outer end of rod 58 of gas cylinder assembly 54, and a pair of cables 66*a*, 66*b* are each connected at one end to cable connector 64. At the opposite end, each of cables 66*a*, 66*b* is interconnected with one of lead screws 32, so that the transverse biasing force of rod 58 is applied as an upward biasing force on each lead screw 32.

Referring to FIGS. 3 and 6, cable 66*a* is engaged with a vertically oriented pulley 68*a* secured to beam vertical wall 44, and with a horizontally oriented pulley 68*b* mounted to beam vertical wall 44 via a pulley mounting bracket 70. Cable 66*a* then passes through an opening in beam vertical wall 44, and is engaged with a vertically oriented pulley 68*c* mounted to the inner wall of lower leg section 26. Cable 66*a* is then routed upwardly for engagement with a transversely oriented vertical pulley 68*d*, which is mounted via a bracket to the inner wall of lower leg section 26 such that an outer portion of pulley 68*d* is located exteriorly of the inner wall of lower leg section 26, and an inner portion of pulley 68*d* extends through an opening in the inner wall of lower leg section 26 and is located in the interior of lower leg section 26. From the inside of pulley 68*d*, cable 66*a* extends in a generally vertical direction parallel to the longitudinal axes of screw 32, lower leg section 26 and upper leg section 28, and is connected at its lower end to a cup member 72 (FIGS. 4,5) that is secured to the lower end of upper leg section 28. Cup member 72 defines an opening through which lead screw guide tube 35 extends. With this arrangement, the transverse, horizontal biasing force of rod 58 is applied through cable 66*a* and pulleys 68*a*-68*d* as an upward vertical biasing force on the lower end of leg upper section 28 through cup member 72. This upward vertical biasing force is then applied to the lower wall of housing 31, which in turn biases worksurface 22 upwardly relative to lower leg section 26.

In a similar manner, as shown in FIGS. 3-5 and 7, the end of cable 66*b* is interconnected with cup member 72 at the lower end of the upper section 28 of the other leg assembly 24. Cable 66*b* is engaged with a horizontally oriented pulley 74*a* mounted to beam vertical wall 44, and extends through an opening in vertical wall 44 into engagement with a horizontally mounted pulley 74*b* mounted to the inner wall of leg lower section 26. Cable 66*b* is then engaged with a vertically oriented pulley 74*c*, which is mounted to the inner wall of lower leg section 26 in a manner similar to that of pulley 68*d*, so that an outer portion of pulley 74*c* is located exteriorly of the inner wall of lower section 26 and an inner portion of pulley 74*c* extends through an opening in the inner wall of lower leg section 26 into the interior of lower leg section 26. From the inside of pulley 74*c*, cable 66*b* extends in a generally vertical direction parallel to the longitudinal axes of screw 32, lower leg section 26 and upper leg section 28, and is connected at its lower end to cup member 72 (FIGS. 4,5) that is secured to the lower end of the other upper leg section 28. In this manner, cable 66*b* converts the transverse horizontal bias of rod 58 into a vertical upward bias on worksurface 22.

Figure 11:
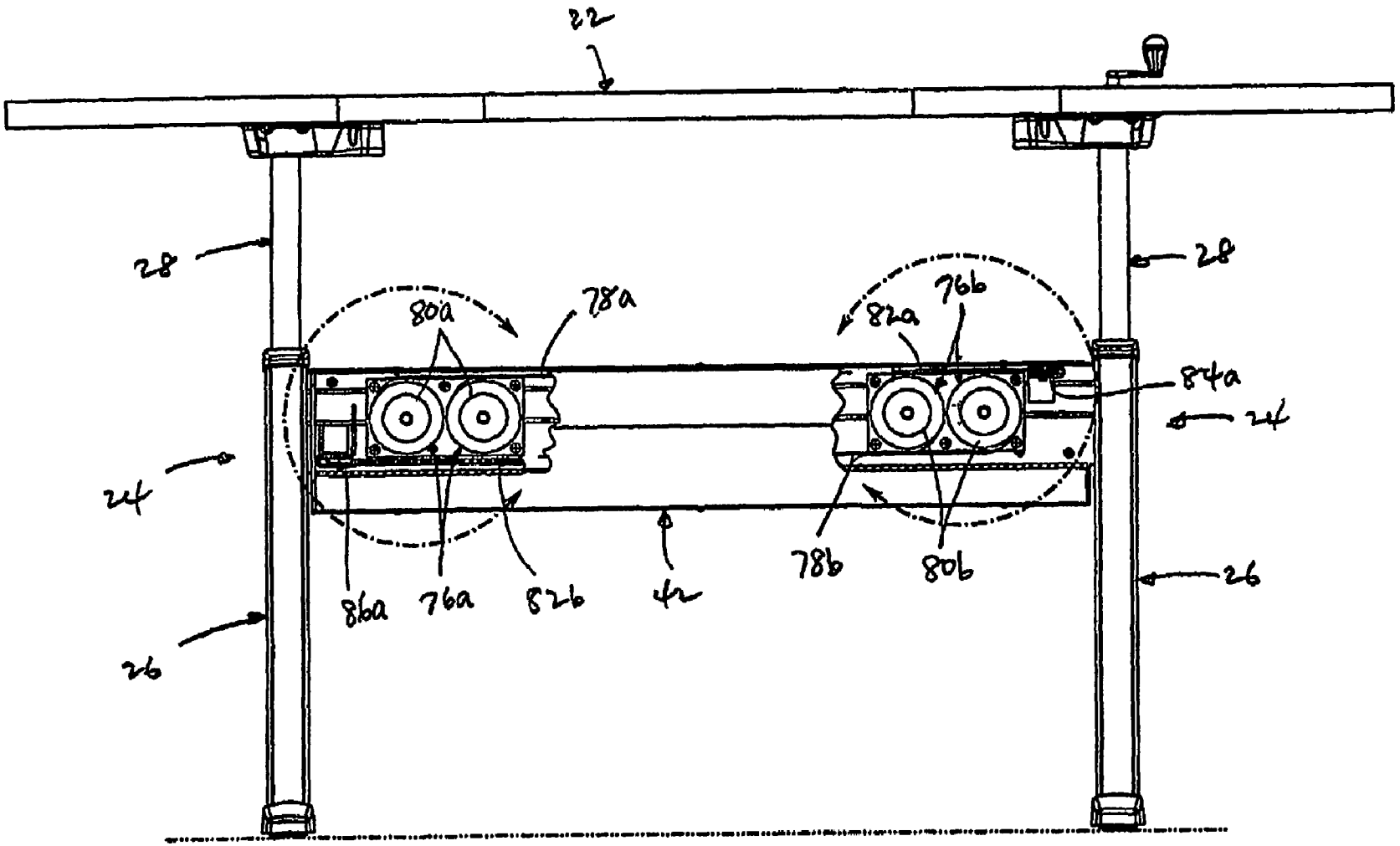
FIG. 11 is a view similar to FIG. 2, showing an alternative embodiment of the lift assist or counterbalancing mechanism incorporated into the table or desk assembly.
Figure 12:
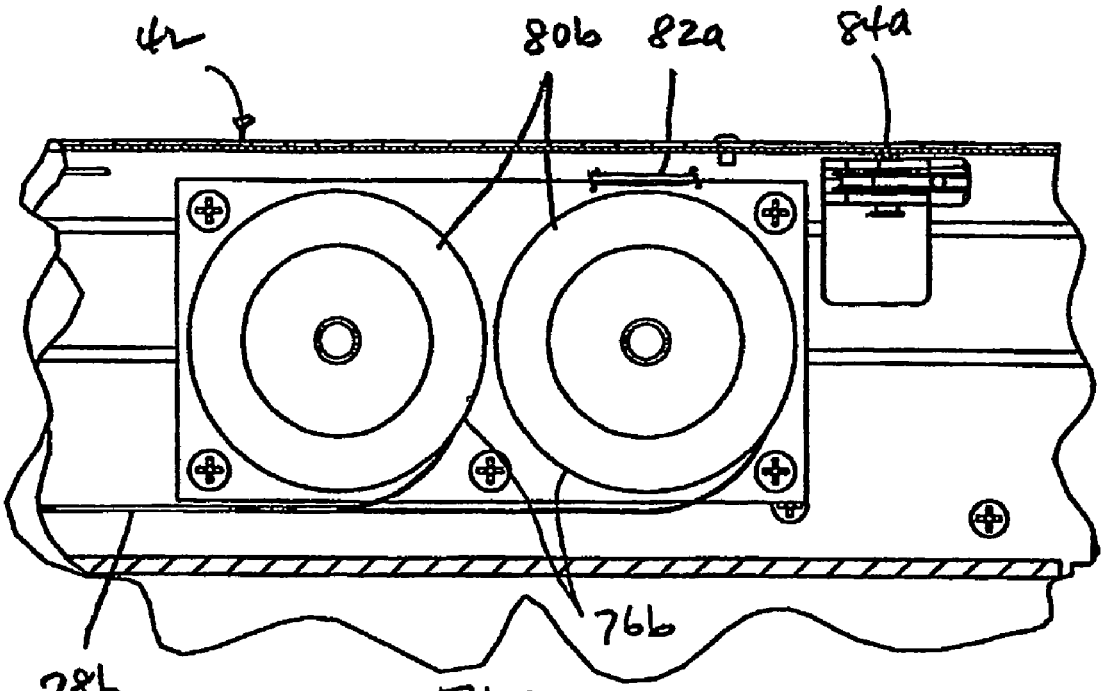
FIG. 12 is a partial elevation view, with portions in section and with reference to line 12-12 of FIG. 11, showing a spring arrangement located at one side of a cross-member incorporated into the base of the table or desk assembly.
Figure 13:
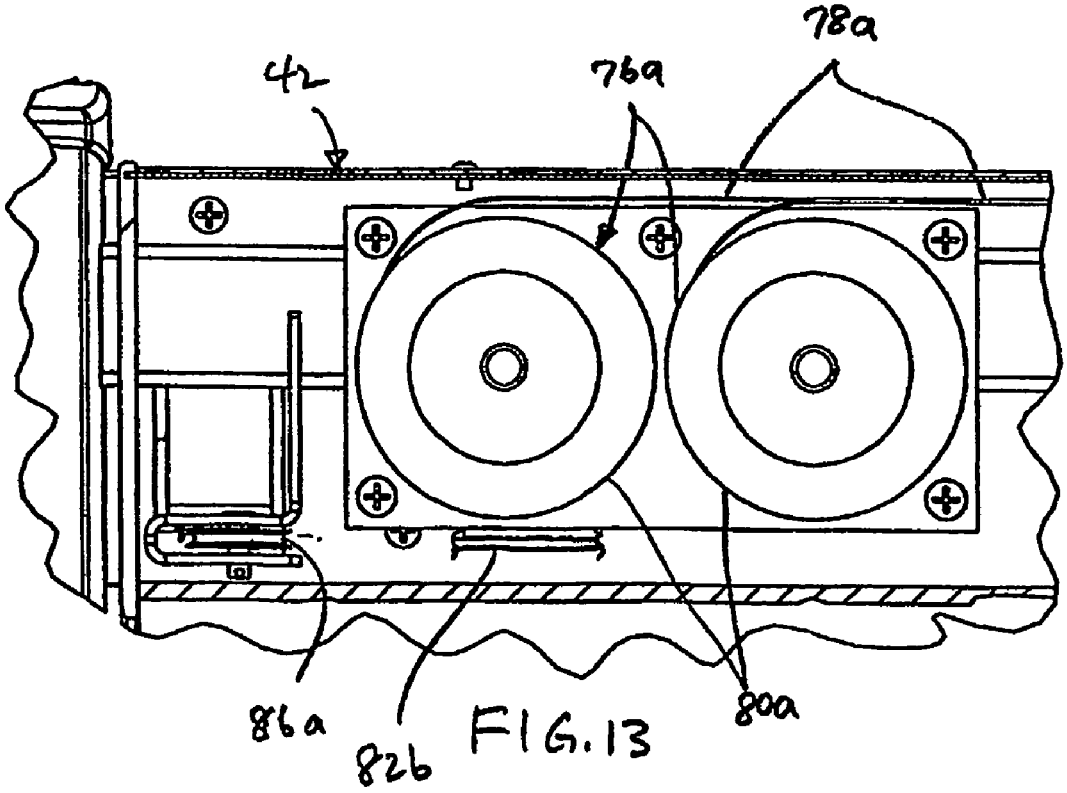
FIG. 13 is a partial elevation view, with portions in section and with reference to line 13-13 of FIG. 11, showing a spring arrangement located at one side of a cross-member incorporated into the base of the table or desk assembly.

FIGS. 11-13 illustrate an alternative arrangement for applying an upward biasing force on worksurface 22. In this embodiment, constant force spring motor assemblies 76 apply a vertical upward force on worksurface 22. A first pair of constant force spring assemblies 76*a*, which are located toward a first end of beam 42, are interconnected with the leg assembly 24 at the opposite end of beam 42. Similarly, a second pair of constant force spring assemblies 76*b* located at the second end of beam 42 are interconnected with the leg assembly 24 at the opposite end of beam 42.

Spring assemblies 76*a* and 76*b* are similarly constructed, including respective extendible and retractable strip members 78*a*, 78*b*. In a known manner, each spring includes a housing or spool, shown at 80*a*, 80*b*, which is interconnected with its associated strip member 78*a*, 78*b*. Each strip member 78*a*, 78*b*, has a tendency to coil onto its associated housing or spool 80*a*, 80*b*, to apply a generally constant inward biasing force throughout the length of the strip member 78*a*, 78, in a known manner.

Spring assemblies 76*a* are oriented such that strip members 78*a* extend outwardly from the upper end of the associated housings 80*a*, and spring assemblies 76*b* are oriented such that strip members 78*b* extend from the lower end of the associated housings 80*b*. In this manner, strip members 78*a* are located toward the top of beam 42, and strip members 78*b* are located below strip members 78*a* toward the bottom of beam 42.

A cable 82*a* is connected between the ends of strip members 78*a* and the lower end of the leg upper section 28 at the opposite side of table 10. Similarly, a cable 82*b* is connected between the ends of strip members 78*b* and the lower end of the leg upper section 28 at the opposite end of table. Cable 82*a* extends about a horizontal inner pulley 84*a* carried by beam 42, and about an upper horizontal pulley carried by lower leg section 26 and a vertical pulley also carried by lower leg section 26, which are configured in a manner similar to pulleys 74*a* and 74*b*. In this manner, cable 82*a* is connected to cup member 72 for applying a vertical upward bias on worksurface 22.

Similarly, cable 82*b* is trained about a pulley 86*a* carried by beam 42, and about a series of pulleys configured similarly to pulleys 68*b*, 68*c* and 68*d*, so as to position cable 82*b* in the interior of lower leg section 26 and to apply a vertical upward biasing force on worksurface 22. Constant force spring assemblies 76*a*, 76*b* apply a constant tensile force to strip members 78*a*, 78*b* throughout the range of extension and retraction of strip members 78*a*, 78*b*, which is selected so as to correspond to the range of movement of leg assembly upper sections 28 relative to lower sections 26.

In both embodiments, the counterbalancing or lift assist mechanism applies an upward bias on both of upper leg sections 28, to counteract the weight of worksurface 22 and any loads carried on worksurface 22 and to thereby assist in raising worksurface 22. The illustrated construction applies the upward bias directly to the worksurface 22, so as to isolate lead screws 32 from the vertical upward biasing force. It is also understood that the vertical upward biasing force could be applied directly to the lower end of each lead screw 32, and transferred through appropriate engagement structure from lead screw 32 to the worksurface 22.

In operation, the vertical upward forces applied to worksurface 22 by spring assemblies gas cylinder assembly 54 or spring assemblies 76*a*, 76*b* functions to assist in extending upper sections 28 of leg assemblies 24 when the user turns one of lead screws 32 using handle member 36. This provides an assist in lifting worksurface 22, to overcome the weight of upper leg sections 28, worksurface 22 and loads supported by worksurface 22. The lift assist enables the use of high lead threads on lead screws 32 and lead nut 33, to provide rapid adjustment in the elevation of worksurface 22 while providing ease of operation in imparting rotation to lead screw 32 via handle member 36.

Figure 8:
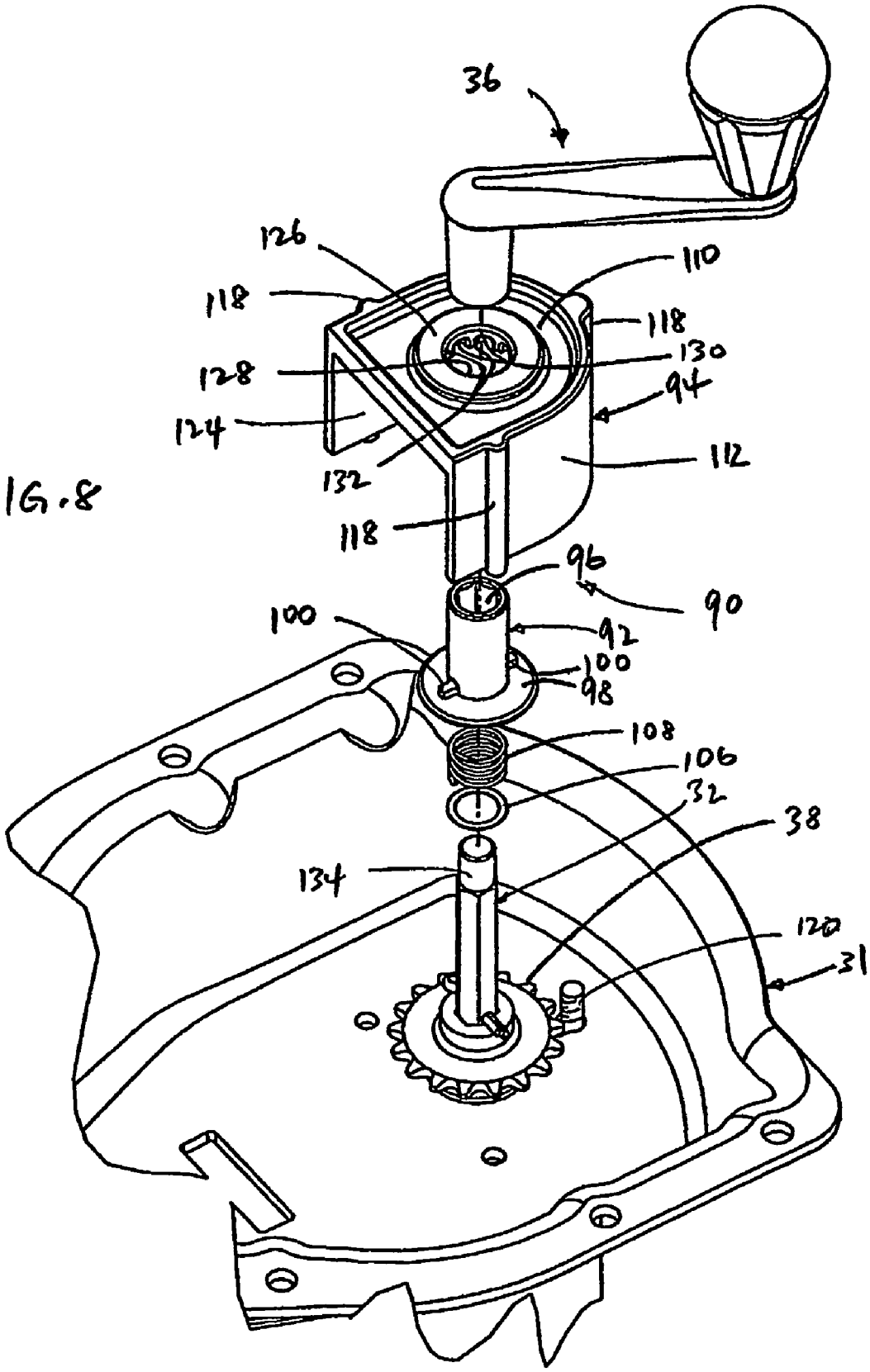
FIG. 8 is an isometric view showing the components of a crank or handle member incorporated in the table or desk assembly of FIG. 1 and including a feature for preventing inadvertent rotation of the threaded rod, and thereby inadvertent upward or downward movement of the worksurface.
Figure 9:
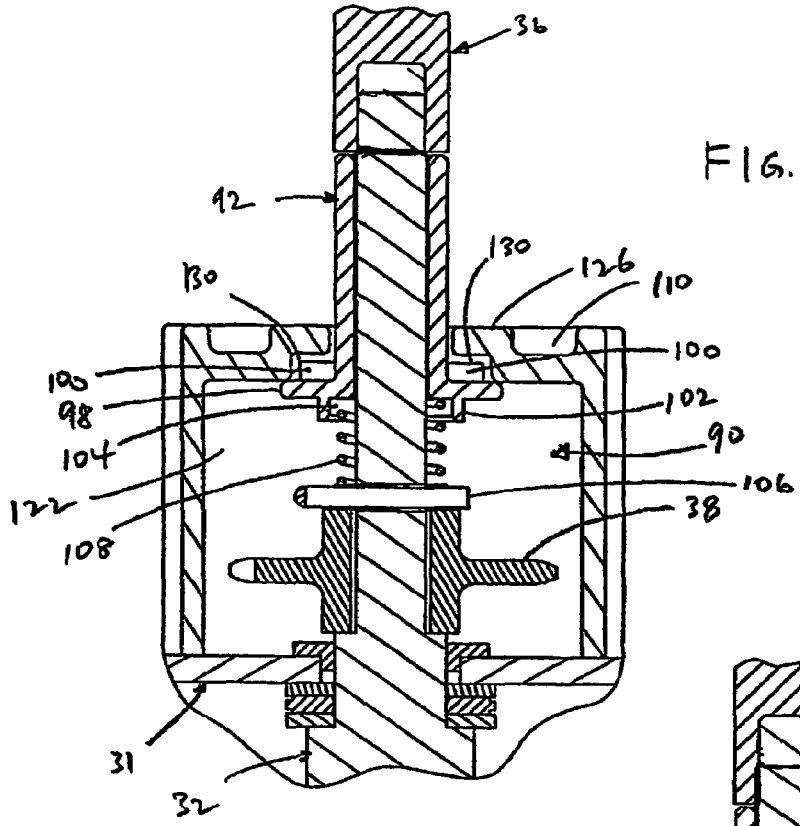
FIG. 9 is a section view showing the components of the crank or handle assembly of FIG. 8, and the retainer arrangement of the present invention in an engaged position for preventing rotation of the threaded rod.
Figure 10:
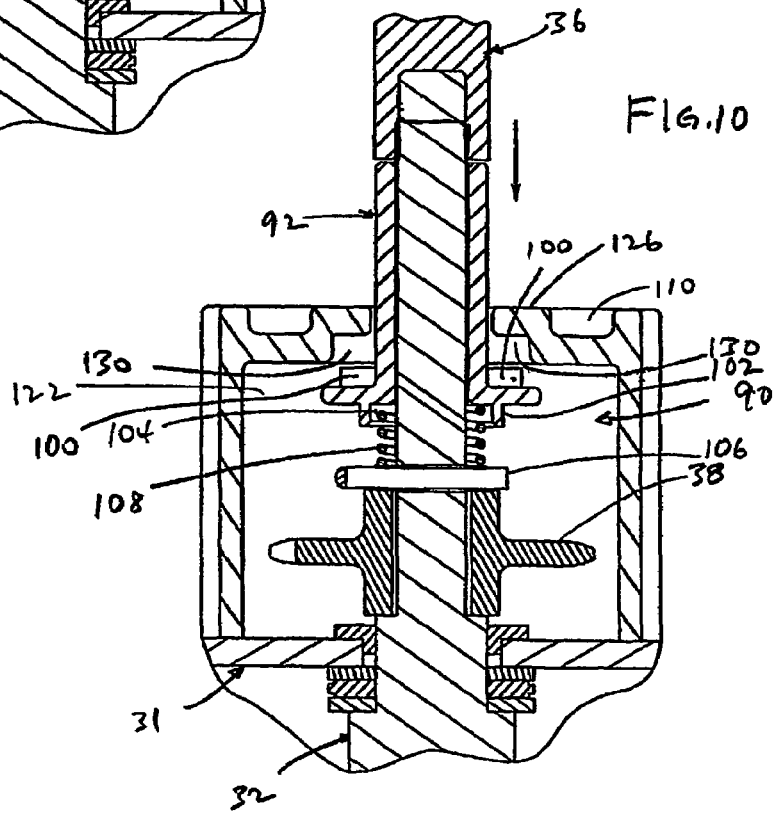
FIG. 10 is a view similar to FIG. 9, showing the retainer arrangement in a disengaged position for enabling rotation of the crank or handle member and thereby rotation of the threaded rod.

Referring to FIGS. 8-10, a detent or retainer arrangement 90 is associated with the upper end of the lead screw 32 that extends upwardly from worksurface 22 and is interconnected with handle member 36. The detent or retainer arrangement 90 includes a locking sleeve 92 interconnected with the upper end of lead screw 32, in combination with a locking block 94 secured to worksurface 22. Retainer arrangement 90 functions to prevent rotation of threaded rods 32 which may otherwise result from backdriving of threaded rods 32 caused by the upward bias on worksurface 22 in the event there is too much or too little weight on worksurface 22.

Locking sleeve 92 defines an axial passage 96 which has a cross section that matches that of the upper end of lead screw 32, such that locking sleeve 92 rotates along with lead screw 32. Representatively, passage 96 and the upper end of lead screw 32 may have a hexagonal cross section. At its lower end, locking sleeve 92 includes an annular flange 98. A pair of opposed ribs 100 extend upwardly from the upper surface of flange 98. An annular wall 102 extends downwardly from the lower surface of flange 98, and defines a recess 104.

A washer 106 rests on a roll pin that extends through the upper end of lead screw 32 at a location below wall 102. The lower end of a spring 108 bears against washer 106, and the upper end of spring 108 bears against the downwardly facing surface of annular flange 98 of locking sleeve 92. In this manner, locking sleeve 92 is biased upwardly in a direction coincident with the longitudinal axis of lead screw 32.

Locking block 94 includes a top wall 110 and a depending side wall 112. Locking block 94 is adapted to be received within a recess 114 defined by worksurface 22, which is located over one of housings 31 secured to the underside of worksurface 22, so as to be in communication with an interior defined by the housing 31. A series of mounting bosses 118 are defined by locking block side wall 112, and each mounting boss 118 includes an axial passage adapted to receive a threaded fastener, such as shown at 120, to secure locking block 94 in position relative to housing 31. Locking block 94 defines an open interior 122 through which the upper end of lead screw 32 extends. One of sprockets 38 is located within the open interior 122 defined by locking block 94, which is formed so as to include an opening 124 through which chain 40 extends.

Top wall 110 of locking block 94 includes a raised central section 126 defining an opening 128, which is adapted to receive the cylindrical upper portion of locking sleeve 92, through which the upper end of lead screw 32 extends. Central section 126 defines a series of radially spaced grooves 130 in its underside. A series of lands 132 are located between grooves 130.

In assembly, spring 108 is operable to urge annular flange 98 of locking sleeve 92 toward top wall 110 of locking block 94. When locking sleeve 92 is in a locking position, ribs 100 are received within an opposed pair of grooves 130, for preventing rotation of lead screw 32. In a release position, locking sleeve 92 is moved downwardly on lead screw 32 so as to disengage ribs 100 from grooves 130, and to enable rotation of lead screw 32.

Locking sleeve 92 is capable of being moved axially relative to lead screw 32, from its locking position to its release position against the force of spring 108, and from its release position to its locking position under the force of spring 108. The hub of handle member 36 is configured so as to have a recess, which corresponds in shape to the upper end of lead screw 32, to enable rotation of lead screw 32 in response to application of a rotational force to handle member 36. The top portion 134 of screw 32 within the recess of handle member 36 is round and not keyed to handle member 36. The lower portion of the recess in handle member 36 is keyed to the irregular cross section of screw 32, such that depressing handle member 36 functions to key handle member 36 and screw 32 together. In this manner, handle member 36 is adapted to be pressed downwardly so as to move locking sleeve 92 to its release position, in which ribs 100 are disengaged from grooves 130, by application of a manual force by the user in a direction parallel to the longitudinal axis of lead screw 32. Grooves 130 are relatively shallow, on the order of ⅛ inch, such that very little axial movement of locking sleeve 92 is required to disengage ribs 100 from grooves 130. When locking sleeve 92 is moved to its release position in this manner, the user applies a rotational force to handle member 36 so as to turn lead screw 32, and to raise or lower worksurface 22. During rotation of lead screw 32 by operation of handle member 36, friction from the cranking force between handle 36 and screw 32 maintains spring 108 in a compressed state. When the desired elevation of worksurface 22 has been attained, the user relieves application of the manual axial force on handle member 36 to relieve such frictional forces, and spring 108 functions to return locking sleeve 92 to its locking position wherein ribs 100 are received within a pair of grooves 130, to prevent further rotation of lead screw 32 and to thereby maintain worksurface 22 in position. In the event ribs 100 are located between grooves 130, and come into contact with lands 132 between grooves 130, the user rotates handle member 36 one way or the other until ribs 100 are moved into alignment with a pair of grooves 130, at which time spring 108 functions to move ribs 100 into a pair of grooves 130 to place locking sleeve 92 in its locking position and to thereby prevent further rotation of lead screw 32.

The construction of handle member 36 and its engagement with the upper end of threaded rod 32 enables a user to maintain handle member 36 in engagement with the upper end of threaded rod 32 at all times, so that handle member 36 is not required to be stored in a drawer or the like, which may lead to handle member 36 being lost or misplaced When in the at-rest position, handle member 36 spins freely on the cylindrical upper end of threaded rod 32, which enables a user to quickly ascertain that handle member 36 is not engaged and can then be pushed downwardly in order to disengage retainer arrangement 90 to adjust the height of worksurface 22.

The axial upward biasing force applied to worksurface 22 by cylinder assembly 54 or spring assemblies 76*a*, 76*b* will tend to rotate lead screw 32. Detent arrangement 90 ensures that lead screw 32 rotates only a small amount before one of ribs 100 is positioned into alignment with a pair of grooves 130. If worksurface 22 is loaded sufficiently to overcome the upward biasing force, such loading of worksurface 22 will overcome the biasing force and tend to apply a force to lead screw 32 which rotates lead screw 32 in a direction providing downward movement of worksurface 22. In this situation, a small amount of downward movement of table 22 is required in order to position ribs 100 into alignment with grooves 130. The detent mechanism 90 provided by locking sleeve 92 and locking block 94 enables use of high lead threads on lead screw 32 in combination with an upward biasing arrangement for worksurface 22 to provide easy operation of lead screw 32*s*, while ensuring that the upward biasing arrangement cannot provide inadvertent rotation of lead screw 32, e.g. when worksurface 22 is lightly loaded or is not loaded.

While the invention has been shown and described with respect to certain embodiments, it is understood that various alternatives and modifications are possible and are contemplated as being within the scope of the present invention. For example, and without limitation, it is contemplated that other types of biasing arrangements may be employed to apply an upward force to the worksurface, in addition to the specific illustrated biasing arrangements. Further, the particular details of the detent mechanism for preventing rotation of the lead screw other than when adjusting the height or the worksurface may vary from those shown and described. As to this feature, the key element is the provision of selectively engageable retainer or detent structure between the lead screw and a stationary member of the table such as the worksurface (although any other component of the table may be employed), for preventing lead screw rotation when the worksurface is adjusted to a desired elevation. In addition, while the drawings and description show a pair of legs or supports, it is understood that the lift assist or counterbalancing mechanism of the present invention may be used with a table or desk assembly having two, three, four or even more legs or supports that are synchronized together.

Various alternatives and modifications are contemplated as being within the scope of the following claims particularly pointing out and distinctly claiming the subject matter regarded as the invention.

We claim:

1. An article of furniture, comprising:

a worksurface;

a base including a pair of extendible and retractable supports interconnected with the worksurface for supporting the worksurface above a supporting surface, wherein each support includes a rotatable lead screw arrangement including an elongated lead screw member interconnected with the worksurface and a stationary mating threaded member, wherein rotation of the lead screw members relative to the stationary mating threaded members results in extension or retraction of the pair of supports to raise or lower the worksurface; and a biasing arrangement configured to apply an axial upward biasing force to the worksurface, wherein the upward biasing force applied to the worksurface assists in rotation of the lead screw members when it is desired to rotate the lead screw members in a direction providing upward movement of the worksurface, wherein the biasing arrangement comprises one or more biasing members remote from the supports, and one or more force transmission members that transmit the biasing force from the one or more biasing members to the worksurface, wherein the one or more biasing members comprises a cylinder assembly interconnected with the base and having a biased extendible and retractable member interconnected with the worksurface for applying an upward biasing force on the worksurface.

2. The article of furniture of claim 1, wherein the base includes a transversely oriented beam member that extends between and interconnects the supports, wherein the cylinder assembly is mounted to the beam member.

3. The article of furniture of claim 2, wherein the one or more force transmission members comprises a cable engaged with a pulley arrangement, wherein each cable defines a first end interconnected with the extendible and retractable member of the cylinder assembly and a second end interconnected with an extendible and retractable section of one of the supports.

4. An article of furniture, comprising:

a worksurface;

a base including a pair of extendible and retractable supports interconnected with the worksurface for supporting the worksurface above a supporting surface, wherein each support includes a rotatable lead screw arrangement including an elongated lead screw member interconnected with the worksurface and a stationary mating threaded member, wherein rotation of the lead screw members relative to the stationary mating threaded members results in extension or retraction of the pair of supports to raise or lower the worksurface; and a biasing arrangement configured to apply an axial upward biasing force to the worksurface, wherein the upward biasing force applied to the worksurface assists in rotation of the lead screw members when it is desired to rotate the lead screw members in a direction providing upward movement of the worksurface, wherein the biasing arrangement comprises one or more biasing members remote from the supports, and one or more force transmission members that transmit the biasing force from the one or more biasing members to the worksurface, wherein the one or more biasing members comprises a spring arrangement.

5. The article of furniture of claim 4, wherein the base includes a transversely oriented beam member that extends between and interconnects the supports, wherein the spring arrangement is mounted to the beam member.

6. The article of furniture of claim 5, wherein the spring arrangement comprises one or more constant force springs, each of which has a spool, and wherein the one or more force transmission members comprises a flexible extendible and retractable member interconnected with each spool which is biased toward a retracted position, and wherein the extendible and retractable member is interconnected with at least one of the supports for applying an upward force to worksurface.

7. The article of furniture of claim 6, wherein the spring arrangement includes a pair of constant force springs, each of which includes a biased extendible and retractable member.

8. The article of furniture of claim 7, wherein each extendible and retractable member is interconnected with the worksurface via a cable defining a first end interconnected with the extendible and retractable member and a second end interconnected with a movable section of one of the supports, wherein the cable is engaged with a pulley arrangement interposed between the extendible and retractable member and the movable section of the support.

9. An article of furniture, comprising:

a worksurface;

a base including a pair of extendible and retractable supports interconnected with the worksurface for supporting the worksurface above a supporting surface, wherein each support includes a rotatable lead screw arrangement including an elongated lead screw member interconnected with the worksurface and a stationary mating threaded member, wherein rotation of the lead screw members relative to the stationary mating threaded members results in extension or retraction of the pair of supports to raise or lower the worksurface; and a biasing arrangement configured to apply an axial upward biasing force to the worksurface, wherein the upward biasing force applied to the worksurface assists in rotation of the lead screw members when it is desired to rotate the lead screw members in a direction providing upward movement of the worksurface, wherein the biasing arrangement comprises one or more biasing members remote from the supports, and one or more force transmission members that transmit the biasing force from the one or more biasing members to the worksurface, wherein the base includes a transversely oriented beam member that extends between and interconnects the pair of supports, and wherein the biasing member is mounted to the beam member, and wherein the force transmission member is extendible and retractable relative to the biasing member.

10. The article of furniture of claim 9, wherein the force transmission member applies a biasing force in a transverse, generally horizontal direction along an axis defined by the transversely oriented beam member, and wherein the supports are oriented generally vertically, and wherein the force transmission member is interconnected with a movable section of each support and is configured to convert the transverse biasing force to an upward biasing force on the movable section of the support.

11. The article of furniture of claim 10, wherein the force transmission member includes a cable defining a first end interconnected with the biasing member and a second end interconnected with the movable section of the support, and a pulley arrangement with which the cable is engaged, wherein the pulley arrangement includes a plurality of pulleys that are configured and arranged to orient the cable in a transverse direction at the interconnection of the first end of the cable with the biasing member and in a generally vertical direction at the interconnection of the second end of the cable with the movable section of the support.

12. The article of furniture of claim 11, wherein the one or more biasing members comprises a cylinder member and a rod member that is extendible and retractable relative to the cylinder member, wherein the force transmission member comprises a pair of cables, each of which defines a first end secured to the rod member and a second end interconnected with the movable section of the support, wherein each cable is engaged with a pulley arrangement interposed between the rod member and the respective movable section with which the cable is interconnected.

13. The article of furniture of claim 11, wherein the one or more biasing members comprises a pair of constant force spring motor assemblies, each of which includes a stationary rotatable spool member and a biased flexible member that is adapted to be wound onto the spool member, and wherein the one or more force transmission members comprises a cable that is interconnected with each of the biased flexible members at a first end and is interconnected with one of the movable support sections at the second end.

14. The article of furniture of claim 9, wherein at least one of the lead screw members is rotatable by means of a manually operable crank member, and further comprising a retainer arrangement interposed between the worksurface and the crank member for selectively preventing rotation of the crank member to prevent inadvertent rotation of the lead screw member.

15. An article of furniture, comprising:

a worksurface;

a base including a pair of extendible and retractable supports interconnected with the worksurface for supporting the worksurface above a supporting surface, wherein each support includes a rotatable lead screw arrangement including an elongated lead screw member interconnected with the worksurface and a stationary mating threaded member, wherein rotation of the lead screw members relative to the stationary mating threaded members results in extension or retraction of the pair of supports to raise or lower the worksurface; and a biasing arrangement configured to apply an axial upward biasing force to the worksurface, wherein the upward biasing force applied to the worksurface assists in rotation of the lead screw members when it is desired to rotate the lead screw members in a direction providing upward movement of the worksurface, wherein the biasing arrangement comprises one or more biasing members remote from the supports, and one or more force transmission members that transmit the biasing force from the one or more biasing members to the worksurface wherein at least one of the lead screw members is rotatable by means of a manually operable crank member, and further comprising a retainer arrangement interposed between the worksurface and the crank member for selectively preventing rotation of the crank member to prevent inadvertent rotation of the lead screw member, wherein the retainer arrangement includes a hub member interconnected with the crank member and mating engagement structure interposed between the hub member and the worksurface for preventing rotation of the hub member and thereby preventing rotation of the crank member and the lead screw member, wherein the hub member is movable between an operative position in which the mating engagement structure is engaged for preventing rotation of the hub member, and a disengaged position in which the mating engagement structure is disengaged for enabling rotation of the hub member and thereby rotation of the lead screw member.

16. The article of furniture of claim 15, further comprising a biasing arrangement engaged with the hub member for biasing the hub member toward the engaged position, and wherein application of an axial manual force to the crank member is operable to overcome the force of the biasing arrangement to move the hub member from the engaged position to the disengaged position.

17. In combination, an article of furniture having a pair of supports, a worksurface, and a transverse member extending between and interconnecting the pair of supports, and a height adjustment mechanism for the article of furniture, the height adjustment mechanism comprising:

a rotatable threaded member associated with each support, wherein each rotatable threaded member is engaged with a mating stationary threaded member associated with the support and is interconnected with the worksurface, wherein rotation of the rotatable threaded member functions to adjust the elevation of the worksurface;

a biased extendible and retractable member engaged with each rotatable threaded member, wherein the biased extendible and retractable member is configured to apply an upward force on the rotatable threaded member, wherein the upward force tends to rotate the rotatable threaded member via engagement of the rotatable threaded member with the stationary threaded member; and an actuator arrangement configured to selectively impart rotation to a first one of the rotatable threaded members, wherein the actuator arrangement includes a synchronizing mechanism for imparting rotation to a second one of the threaded members upon rotation of the first threaded member, and wherein the actuator arrangement further includes a detent mechanism for selectively preventing rotation of the first rotatable threaded member.

18. In combination, an article of furniture having a pair of supports, a worksurface, and a transverse member extending between and interconnecting the pair of supports, and a height adjustment mechanism for the article of furniture, the height adjustment mechanism comprising:

a rotatable threaded member associated with each support, wherein each rotatable threaded member is engaged with a mating stationary threaded member associated with the support and is interconnected with the worksurface, wherein rotation of the rotatable threaded member functions to adjust the elevation of the worksurface;

a biased extendible and retractable member engaged with each rotatable threaded member for applying an upward force on the worksurface, wherein the upward force tends to rotate the rotatable threaded member via engagement of the rotatable threaded member with the stationary threaded member; and an actuator arrangement for selectively imparting rotation to a first one of the rotatable threaded members, wherein the actuator arrangement includes a synchronizing mechanism for imparting rotation to a second one of the threaded members upon rotation of the first threaded member, and wherein the actuator arrangement further includes a detent mechanism for selectively preventing rotation of the first rotatable threaded member, and wherein the actuator arrangement includes a manually operable handle member engaged with the first rotatable threaded member for selectively imparting rotation to the first threaded member, wherein the detent mechanism is configured to selectively prevent rotation of the manually operable handle member.

19. The combination of claim 18, wherein the detent mechanism includes a retainer member that is movable between a locking position for selectively preventing rotation of the first rotatable threaded member and a release position for selectively enabling rotation of the first rotatable threaded member, and a biasing arrangement for biasing the retainer member toward the locking position.

20. The combination of claim 19, wherein the retainer member comprises a sleeve member that is interconnected with the first rotatable threaded member and is rotatable therewith, and wherein the detent mechanism further includes a stationary locking member, wherein the sleeve member and the locking member include complementary engagement structure which is engaged when the sleeve member is in the locking position and which is disengaged when the sleeve member is in the release position.

21. The combination of claim 20, wherein the sleeve member is biased toward engagement with the locking member via a spring interconnected with the first rotatable threaded member and which is configured so as to urge the sleeve member toward the locking position in which the complementary engagement structure is engaged together.

22. In combination, an article of furniture having a pair of supports, a worksurface, and a transverse member extending between and interconnecting the pair of supports, and a height adjustment mechanism for the article of furniture, the height adjustment mechanism comprising:

a rotatable threaded member associated with each support, wherein each rotatable threaded member is engaged with a mating stationary threaded member associated with the support and is interconnected with the worksurface, wherein rotation of the rotatable threaded member functions to adjust the elevation of the worksurface;

a biased extendible and retractable member engaged with each rotatable threaded member for applying an upward force on the worksurface, wherein the upward force tends to rotate the rotatable threaded member via engagement of the rotatable threaded member with the stationary threaded member, and wherein the biased extendible and retractable member is mounted to the transverse member and is configured to apply a transverse biasing force, and further comprising a cable and pulley system interconnected between the biased extendible and retractable member and the rotatable threaded members for translating the transverse biasing force into an upward biasing force applied to the worksurface; and an actuator arrangement for selectively imparting rotation to a first one of the rotatable threaded members, wherein the actuator arrangement includes a synchronizing mechanism for imparting rotation to a second one of the threaded members upon rotation of the first threaded member, and wherein the actuator arrangement further includes a detent mechanism for selectively preventing rotation of the first rotatable threaded member.

23. A method of adjusting the height of a worksurface in an article of furniture having a pair of spaced apart supports and a worksurface extending between and supported by the pair of supports, comprising the steps of:

providing each support with a rotatable threaded member, wherein the rotatable threaded member is interconnected with the worksurface and is threadedly engaged with a stationary threaded member associated with a stationary portion of the support;

providing a biasing force at a location remote from the supports; and transmitting the biasing force from the remote location via one or more force transmission members that transmit the biasing force to the worksurface and apply an upward bias to the worksurface, wherein the threads of the rotatable threaded member and the threads of the stationary threaded member are configured such that the upward bias on the worksurface imparts a rotational bias on the rotatable threaded member tending to rotate the rotatable threaded member relative to the stationary threaded member so as to assist in raising the worksurface, wherein the step of providing a biasing force is carried out by operation of a biased extendible and retractable member.

24. The method of claim 23, wherein the biased extendible and retractable member comprises a cylinder assembly having a cylinder body and a biased extendible and retractable rod, and wherein the step of transmitting the biasing force from the remote location is carried out by interconnecting the extendible and retractable rod with the worksurface via the one or more force transmission members.

25. The method of claim 24, wherein the article of furniture includes a transverse member that extends between and interconnects the pair of supports, and including the step of mounting the cylinder body to the transverse member such that the biased extendible and retractable rod exerts a transverse biasing force, and wherein the one or more force transmission members comprises a cable member interconnected with the extendible and retractable rod and with a movable section of each support with which the worksurface is interconnected, wherein the cable member is arranged such that the cable member applies an upward force on the movable section of each support.

26. The method of claim 23, wherein the article of furniture includes a transverse member that extends between and interconnects the pair of supports, wherein the one or more force transmission members comprises a spool member interconnected with the transverse member, wherein an extendible and retractable wound member engages the spool member and a movable section of each support with which the worksurface is interconnected.

27. A method of adjusting the height of a worksurface in an article of furniture having a pair of spaced apart supports and a worksurface extending between and supported by the pair of supports, comprising the steps of:

providing each support with a rotatable threaded member, wherein the rotatable threaded member is interconnected with the worksurface and is threadedly engaged with a stationary threaded member associated with a stationary portion of the support:

providing a biasing force at a location remote from the supports;

transmitting the biasing force from the remote location via one or more force transmission members that transmit the biasing force to the worksurface and apply an upward bias to the worksurface, wherein the threads of the rotatable threaded member and the threads of the stationary threaded member are configured such that the upward bias on the worksurface imparts a rotational bias on the rotatable threaded member tending to rotate the rotatable threaded member relative to the stationary threaded member so as to assist in raising the worksurface; and selectively preventing rotation of the rotatable threaded members so as to selectively fix the height of the worksurface, wherein the rotatable threaded members are interconnected together via a synchronizing mechanism that imparts rotation to a second one of the rotatable threaded members in response to rotation of the first rotatable threaded member, and wherein the step of selectively preventing rotation of the rotatable threaded members is carried out by selectively preventing rotation of the first threaded member other than when it is desired to adjust the height of the worksurface, wherein the step of selectively preventing rotation of the first threaded member is carried out by engaging a hub member with the first rotatable threaded member, providing engagement structure between the hub member and stationary structure associated with the article of furniture, and selectively positioning the hub member in an engaged position in which the engagement structure functions to prevent rotation of the hub and therefore the first threaded member.

28. The method of claim 27, further comprising the step of moving the hub member to a disengaged position in which the engagement structure between the hub member and the stationary structure is disengaged so as to enable rotation of the hub member and thereby rotation of the first rotatable member.

29. The method of claim 28, further comprising the step of biasing the hub member toward the engaged position, and wherein the hub member is adapted to be moved to the disengaged position against the biasing force by application of an axial force to the hub member that moves the hub member out of engagement with the engagement structure.

30. The method of claim 29, wherein the axial force is applied to the hub member via a manually operable handle member that is adapted for selective engagement with the hub member.

31. A height adjustment mechanism for an article of furniture having a pair of supports, a worksurface, and a transverse member extending between and interconnecting the pair of supports, comprising:

a pair of rotatable threaded members, each rotatable threaded member configured to associate with a support, wherein each rotatable threaded member is engaged with a mating stationary threaded member associated with the support and is interconnected with the worksurface, wherein rotation of the rotatable threaded member relative to the mating stationary threaded member functions to adjust the elevation of the worksurface;

a biased extendible and retractable member engaged with each rotatable threaded member, wherein the biased extendible and retractable member is configured to apply an upward force on the worksurface, wherein the upward force tends to rotate the rotatable threaded member via engagement of the rotatable threaded member with the stationary threaded member; and an actuator arrangement configured to selectively impart rotation to a first one of the rotatable threaded members, wherein the actuator arrangement includes a synchronizing mechanism configured to rotate to a second one of the threaded members upon rotation of the first threaded member, and wherein the actuator arrangement further includes a detent mechanism configured to selectively prevent rotation of the first rotatable threaded member.

32. A height adjustment mechanism for an article of furniture having a pair of supports, a worksurface, and a transverse member extending between and interconnecting the pair of supports, comprising:

a pair of rotatable threaded members, each rotatable threaded member configured to associate with a support, wherein each rotatable threaded member is engaged with a mating stationary threaded member associated with the support and is interconnected with the worksurface, wherein rotation of the rotatable threaded member functions to adjust the elevation of the worksurface;

a biased extendible and retractable member engaged with each rotatable threaded member for applying an upward force on the worksurface, wherein the upward force tends to rotate the rotatable threaded member via engagement of the rotatable threaded member with the stationary threaded member; and an actuator arrangement for selectively imparting rotation to a first one of the rotatable threaded members, wherein the actuator arrangement includes a synchronizing mechanism for imparting rotation to a second one of the threaded members upon rotation of the first threaded member, and wherein the actuator arrangement further includes a detent mechanism for selectively preventing rotation of the first rotatable threaded member, and wherein the actuator arrangement includes a manually operable handle member engaged with the first rotatable threaded member for selectively imparting rotation to the first threaded member, wherein the detent mechanism is configured to selectively prevent rotation of the manually operable handle member.

33. The height adjustment mechanism of claim 32, wherein the detent mechanism includes a retainer member that is movable between a locking position for selectively preventing rotation of the first rotatable threaded member and a release position for selectively enabling rotation of the first rotatable threaded member, and a biasing arrangement for biasing the retainer member toward the locking position.

34. The height adjustment mechanism of claim 33, wherein the retainer member comprises a sleeve member that is interconnected with the first rotatable threaded member and is rotatable therewith, and wherein the detent mechanism further includes a stationary locking member, wherein the sleeve member and the locking member include complementary engagement structure which is engaged when the sleeve member is in the locking position and which is disengaged when the sleeve member is in the release position.

35. The height adjustment mechanism of claim 34, wherein the sleeve member is biased toward engagement with the locking member via a spring interconnected with the first rotatable threaded member and which is configured so as to urge the sleeve member toward the locking position in which the complimentary engagement structure is engaged together.

36. The height adjustment mechanism of claim 31, wherein the biased extendible and retractable member is mounted to the transverse member and is configured to apply a transverse biasing force, and further comprising a cable and pulley system interconnected between the biased extendible and retractable member and the rotatable threaded members for translating the transverse biasing force into an upward biasing force applied to the worksurface.

* * * * *